US008182277B2

(12) United States Patent
Yokoo et al.

(10) Patent No.: US 8,182,277 B2
(45) Date of Patent: May 22, 2012

(54) CONNECTOR

(75) Inventors: Hiroyuki Yokoo, Tokyo (JP); Nobukazu Kato, Tokyo (JP); Masao Higuchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/804,327

(22) Filed: Jul. 20, 2010

(65) Prior Publication Data

US 2011/0021055 A1 Jan. 27, 2011

(30) Foreign Application Priority Data

Jul. 27, 2009 (JP) ..... 2009-174079

(51) Int. Cl.
*H01R 13/15* (2006.01)

(52) U.S. Cl. ..... 439/260; 439/495

(58) Field of Classification Search ..... 439/329, 439/499, 495, 493, 492, 260
See application file for complete search history.

(56) References Cited

U.S. PATENT DOCUMENTS

| | | | | |
|---|---|---|---|---|
| 5,580,272 | A | 12/1996 | Yamaguchi et al. | |
| 6,471,541 | B2 | 10/2002 | Kunishi et al. | |
| 7,270,567 | B2 * | 9/2007 | Inoue | 439/495 |
| 7,604,499 | B2 | 10/2009 | Sunaga | |

FOREIGN PATENT DOCUMENTS

| | | |
|---|---|---|
| JP | 2892945 | 2/1996 |
| JP | 9-283240 | 10/1997 |
| JP | 2001-076794 | 3/2001 |
| JP | 2001-345136 | 12/2001 |
| JP | 2003-346948 | 12/2003 |
| JP | 2008-310964 | 12/2008 |

OTHER PUBLICATIONS

Japanese Office Action dated May 19, 2011 in JP 2009-174079 with English translation of same.

* cited by examiner

*Primary Examiner* — Felix O Figueroa
(74) *Attorney, Agent, or Firm* — Collard & Roe, P.C.

(57) ABSTRACT

A connector has a housing, an insertion slot, an actuator and a biasing member. Into the insertion slot, a connection target is inserted along an insertion direction. The actuator has a pusher. The actuator is held on the housing so as to be turnable between an open position and a close position. The actuator allows the connection target to be inserted into the insertion slot when the actuator is positioned at the open position. The pusher pushes the inserted connection target along a thickness direction of the connection target when the actuator is turned to the close position after the connection target is inserted into the insertion slot. The thickness direction is perpendicular to the insertion direction. The biasing member is operable to bias the pusher toward the inserted connection target when the actuator is located at the close position.

6 Claims, 3 Drawing Sheets

CONNECTOR

CROSS REFERENCE TO RELATED APPLICATIONS

Applicants claim priority under 35 U.S.C. §119 of Japanese Patent Application No. JP2009-174079 filed Jul. 27, 2009.

BACKGROUND OF THE INVENTION

The present invention relates to a connector connectable to a flexible printed circuit (FPC) or a flexible flat cable (FFC).

For example, this type of connector is disclosed in JP-B 2892945. JP-B 2892945 discloses a conventional connector in which a pusher applies a pressure to an FPC while moving rearward along an insertion direction when an actuator is turned from an open position to a close position. JP-B 2892945 also discloses a connector in which a pusher applies a pressure to an FPC while moving frontward along an insertion direction (toward a reverse direction of the insertion direction) when an actuator is turned from an open position to a close position.

In those connectors disclosed in JP-B 2892945, when the actuator is turned about an axis of turn, the pusher is also turned about the same axis. Therefore, the pusher moves rearward or frontward along the insertion direction. Due to this movement of the pusher, contacting sections of contacts are likely to be disconnected from a connection portion (wiring pattern) of the FPC or FFC.

SUMMARY OF THE INVENTION

It is, therefore, an object of the present invention to provide a connector capable of preventing a contacting section of a contact from being disconnected from a connection portion (wiring pattern) of an FPC or FFC when an actuator is turned.

One aspect of the present invention provides a connector which has a housing, an insertion slot, an actuator and a biasing member. Into the insertion slot, a connection target is inserted along an insertion direction. The actuator has a pusher. The actuator is held on the housing so as to be turnable between an open position and a close position. The actuator allows the connection target to be inserted into the insertion slot when the actuator is positioned at the open position. The pusher pushes the inserted connection target along a thickness direction of the connection target when the actuator is turned to the close position after the connection target is inserted into the insertion slot. The thickness direction is perpendicular to the insertion direction. The biasing member is operable to bias the pusher toward the inserted connection target when the actuator is located at the close position.

An appreciation of the objectives of the present invention and a more complete understanding of its structure may be had by studying the following description of the preferred embodiment and by referring to the accompanying drawings.

Figure 1:
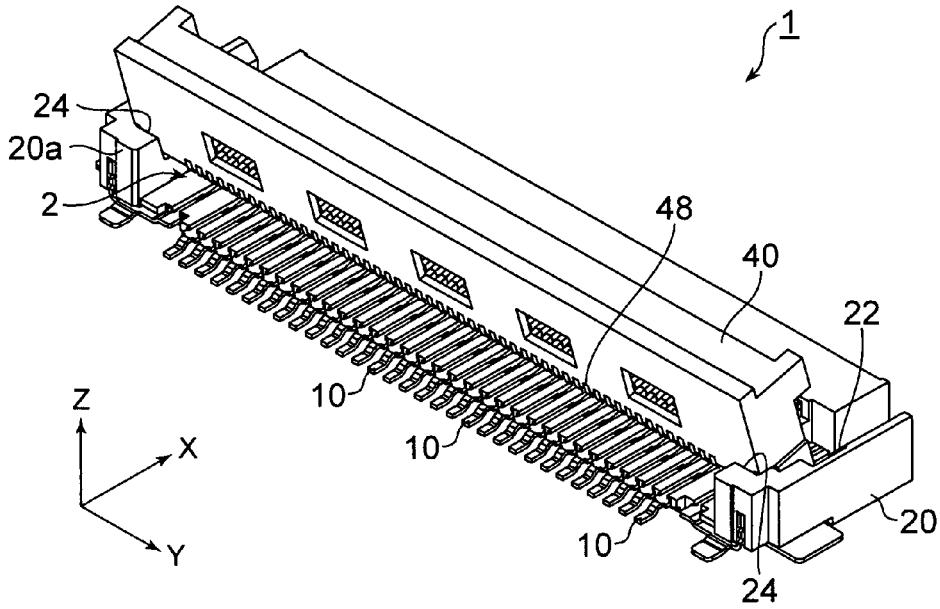
FIG. 1 is a perspective view showing a connector according to an embodiment of the present invention, in which an actuator included in the connector is located at an open position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
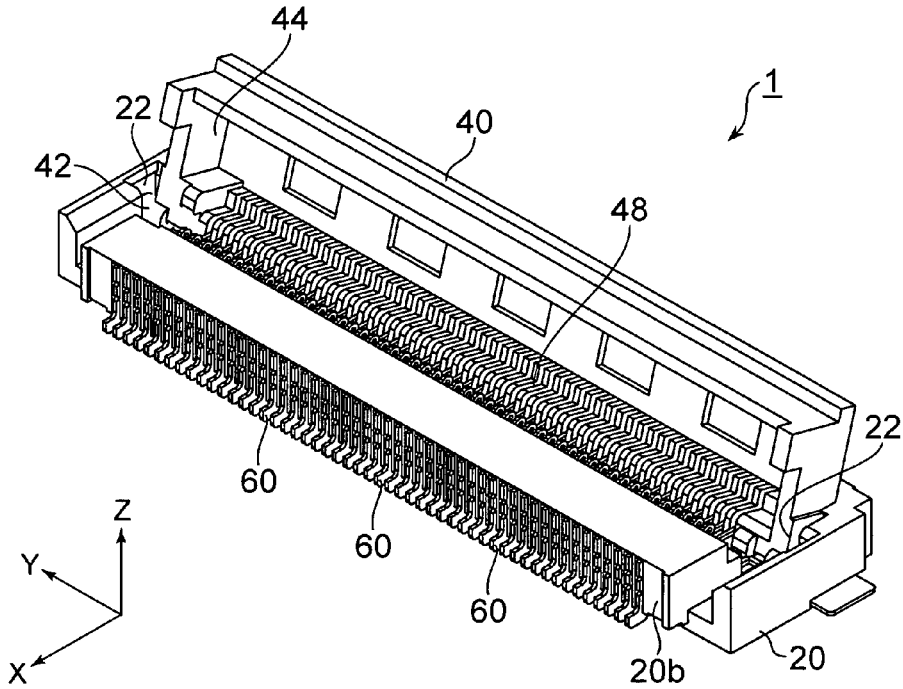
FIG. 2 is another perspective view showing the connector of FIG. 1, in which the actuator included in the connector is located at the open position.
Figure 3:
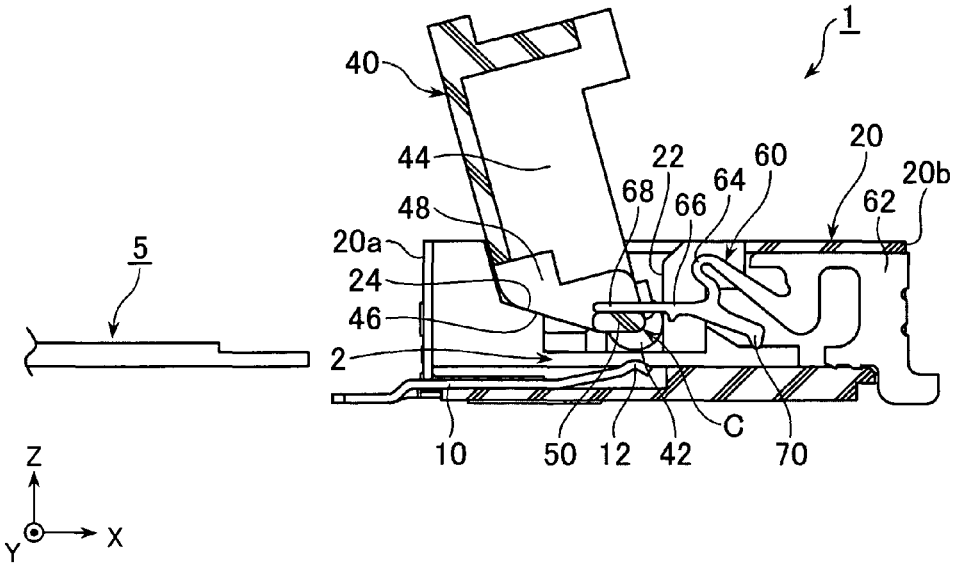
FIG. 3 is a cross-sectional view showing the connector of FIG. 1, in which the actuator is located at the open position.
Figure 4:
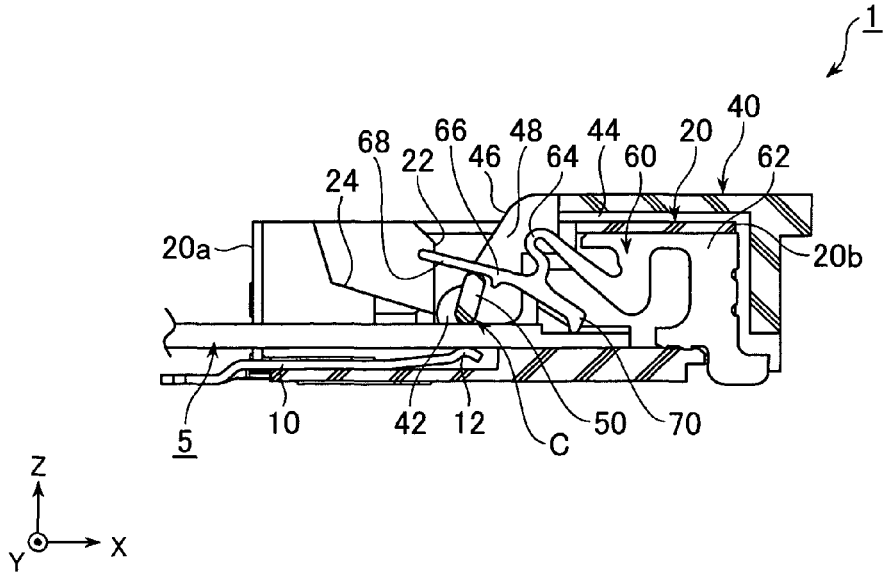
FIG. 4 is a cross-sectional view showing the connector of FIG. 1, in which the actuator is located at a close position.

Referring to FIGS. 1 and 2, a connector 1 according to an embodiment of the present invention includes contacts 10 made of metal, a housing 20 for holding the contacts 10, an actuator 40 turnable with respect to the housing 20, and contacts (biasing members) 60 made of metal. The housing 20 and the actuator 40 have insulating properties. The contacts 60 are held on the housing 20. As shown in FIGS. 3 and 4, the connector 1 is connectable to an FPC (or FFC) 5. A connection portion such as a wiring pattern (not shown) is formed on each of an upper surface and a lower surface of the FPC (or FFC) 5.

As shown in FIGS. 3 and 4, the contacts 10 are pressed into the housing 20 from a front end 20*a* of the housing 20, into which the FPC (or FFC) 5 is inserted, toward a rear end 20*b* and are thus held by the housing 20. Each of the contacts 10 has a contacting section 12 that is brought into contact with the connection portion formed on the lower surface of the FPC 5. Each of the contacting sections 12 is movable along a direction of the thickness of the connector 1 (the Z-direction) by the spring characteristics of the contacts 10.

Referring to FIGS. 1 to 4, the housing 20 includes pivot receivers 22 formed on opposite sides of the connector 1 in the width direction (the Y-direction). The housing 20 also includes turn regulators 24 formed between the corresponding pivot receiver 22 and the front end 20*a* in an insertion direction (the X-direction), in which the FPC 5 is inserted into the connector 1. Each of the pivot receivers 22 is formed by a groove recessed in the Y-direction so as to extend along the Z-direction. In this embodiment, upper edge corners of the pivot receivers 22 are beveled from the viewpoint of attachment of the actuator 40, which will be described later. The turn regulators 24 receive part of the actuator 40 to regulate the turn range of the actuator 40 (see FIGS. 1 and 3).

Referring to FIGS. 3 and 4, the contacts 60 are pressed into the housing 20 from the rear end 20*b* of the housing 20 toward the front end 20*a* and are thus held by the housing 20. Specifically, each of the contacts 60 includes a base 62 held near the rear end 20*b* of the housing 20, a spring section 64 supported on the base 62, and a finger section 66 elastically supported by the spring section 64. The finger section 66 of this embodiment includes a front part 68 and a rear part 70. The finger section 66 is supported between the front part 68 and the rear part 70 by the spring section 64. FIG. 3 shows an initial state of the finger section 66. The front part 68 of the finger section 66 is used to push part of the actuator 40, which will be described later. The rear part 70 of the finger section 66 is used to establish connection with the connection portion formed on the upper surface of the FPC 5. When the front part 68 of the finger section 66 is pushed upward in the initial state shown in FIG. 3, the rear part 70 is moved downward. If the FPC 5 is inserted in an insertion slot 2, then the rear part 70 is pressed against the connection portion formed on the upper surface of the FPC 5 by the downward movement of the rear part 70 (see FIG. 4). At that time, a downward reaction force is applied to a member that has pushed up the front part 68.

Referring to FIGS. 1 to 4, the actuator 40 includes pivots 42 provided on opposite sides of the actuator 40 in the Y-direction, a receptacle portion 44, facing portions 46, communication slits 48, and pushers 50.

As can be seen from FIG. 2, the pivots 42 project outward from the opposite ends of the actuator 40 along the Y-direction. The pivots 42 are received in the pivot receivers 22 of the housing 20. When the pivots 42 are respectively received in the pivot receivers 22, the actuator 40 of this embodiment is rotatable between an open position (FIG. 3) and a close position (FIG. 4).

The facing portions 46 are located on the opposite ends of the actuator 40 in the Y-direction. The facing portions 46 are formed by part of a front surface and an upper surface of the actuator 40. The terms "front" and "upper" are defined based on a state where the actuator 40 is located at the close position. This holds true for other explanations relating to the actuator 40. As shown in FIG. 3, when the actuator 40 is located at the open position, the facing portions 46 of the actuator 40 are received by the turn regulators 24. Thus, the actuator 40 is prevented from turning over the open position. In the present embodiment, the actuator 40 is turned from the open position to the close position by pushing down the actuator 40 toward the insertion direction (the positive X-direction). However, the present invention is not limited to this example. The actuator 40 may be turned from the open position to the close position by pushing down the actuator 40 toward a direction opposite to the insertion direction (the negative X-direction). In this case, the turn regulators 24 are located between the pivot receivers 22 and the rear end 20*b* of the housing 20 in the insertion direction, and the facing portions 46 are formed by part of the upper surface and a rear surface of the actuator 40.

As shown in FIG. 4, the receptacle portion 44 receives a portion of the housing 20 near the rear end 20*b* when the actuator 40 is located at the close position.

As can be seen from FIGS. 3 and 4, the communication slits 48 communicate the front surface of the actuator 40 with the receptacle portion 44. One communication slit 48 is provided for each contact (biasing member) 60. Specifically, the finger sections 66 of the contacts 60, particularly the front parts 68, are located within the communication slits 48.

The pushers 50 are provided near a lower portion of the front surface of the actuator 40 (near the front edge of the actuator 40). Part of the pushers 50 is exposed within the communication slits 48. With this configuration, the pushers 50 can contact the finger sections 66 of the contacts 60 within the communication slits 48.

When the actuator 40 is located at the open position as shown in FIGS. 1 and 3, the pushers 50 are located at a relatively upper position. The actuator 40 and the housing 20 define the insertion slot 2 into which the FPC 5 can be inserted along the X-direction. As can be seen from FIG. 3, when the FPC 5 is not inserted in the insertion slot 2, the contacting sections 12 of the contacts 10 are located within the insertion slot 2.

Meanwhile, when the actuator 40 is located at the close position, the pushers 50 of the actuator 40 are biased downward by the finger sections 66 of the contacts 60. Specifically, when the actuator 40 is turned from the open position to the close position in a state where the FPC 5 is inserted in the insertion slot 2, the finger sections 66 of the contacts 60 bias the pushers 50 such that the pushers 50 substantially press the FPC 5 only along the Z-direction.

The pivots 42 and the pushers 50 of this embodiment will be described in greater detail with reference to FIGS. 3 to 6.

The pivots 42 of this embodiment have a circular cross-section on the XZ-plane. The diameter of the pivots 42 is slightly smaller than the length of the pivot receivers 22 of the housing 20 along the X-direction, i.e., the width of the grooves that constitute the pivot receivers 22. With this configuration, movement of the pivots 42 along the X-direction is regulated while the pivots 42 are allowed to rotate or to move in the Z-direction within the pivot receivers 22.

Figure 5:
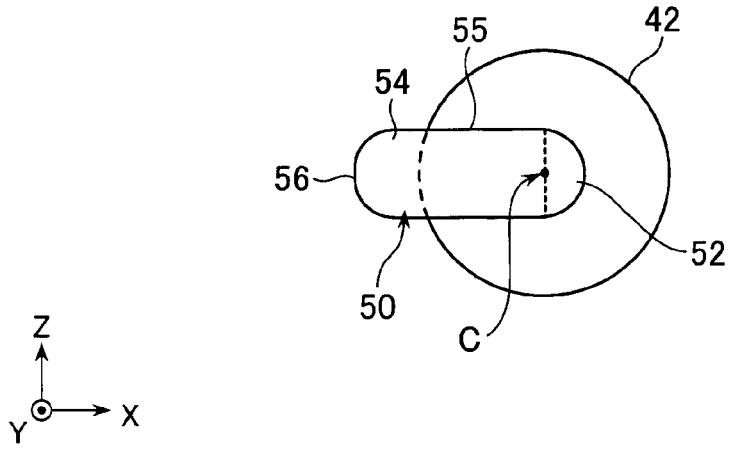
FIG. 5 is a view showing a relationship between a pusher and a pivot when the actuator is located at the open position.
Figure 6:
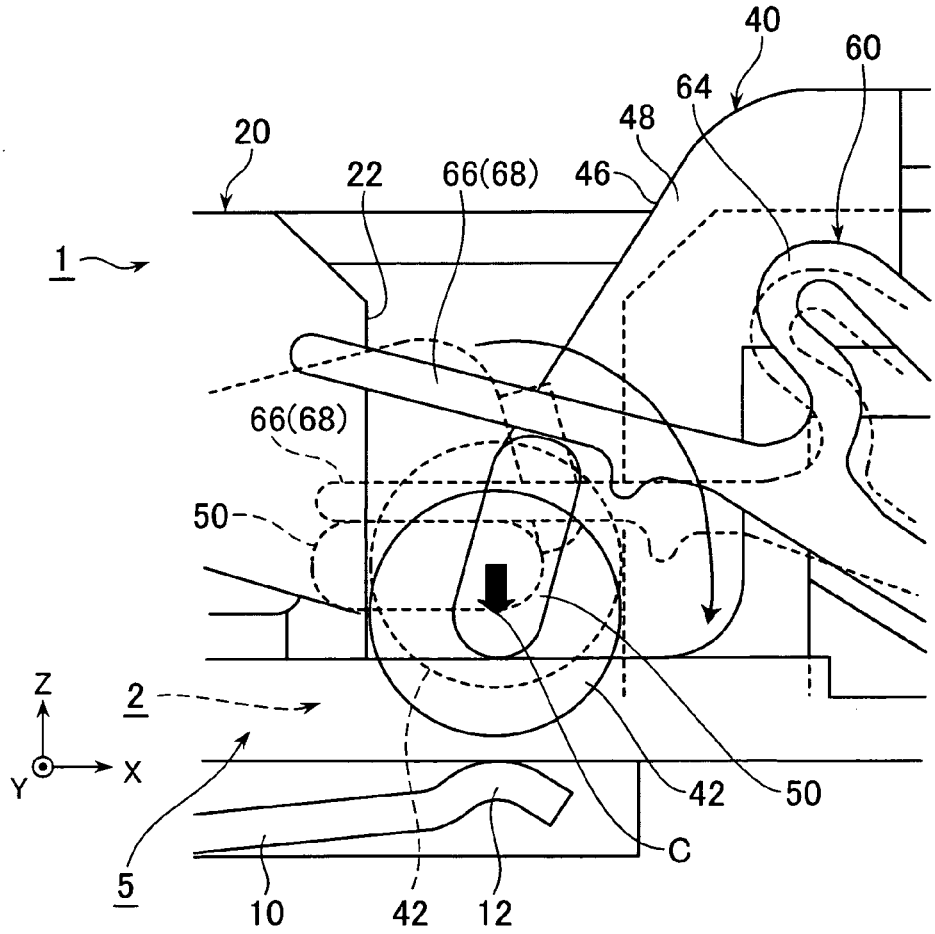
FIG. 6 is a view showing operation of the pusher and the pivot.

As can be seen from FIGS. 3 to 5, each of the pushers 50 of this embodiment includes an abutment section 52 having a semicircular cross-section on the XZ-plane and a transmission section 54 that is brought into contact with the corresponding finger section 66 of the contact 60. The transmission section 54 transmits a force applied by the corresponding contact 60 to the abutment section 52.

The pusher 50 turns or pivots about the center C of the semicircular shape of the abutment section 52. The center C of the semicircular shape of the abutment section 52 is aligned with the center of the pivot 42. Specifically, the centers of turn of the pushers 50 are aligned with the centers of the pivots 42 in the present embodiment. Since the abutment section 52 has a semicircular shape, the contact point of the abutment section 52 with the FPC 5 moves only along a line that passes through the center C and extends along the Z-direction when the abutment section 52 is pressed against the FPC 5 by turn of the actuator 40 (see the thick black arrow in FIG. 6). Furthermore, when the actuator 40 is turned, the abutment section 52 applies a force to the FPC 5 only along the (negative) Z-direction. Specifically, according to the present embodiment, no shearing force is applied to the FPC 5 when the pushers 50 push the FPC 5.

Particularly, in the present embodiment, each of the contacting sections 12 of the contacts 10 is located on a line that passes the center C of turn of the corresponding abutment section 52 and extends in parallel to the Z-direction. In other words, the center of turn of the pusher 50 and the corresponding contacting section 12 of the contact 10 are arranged along the Z-direction. Therefore, the abutment sections 52 move (approach) toward the contacting sections 12 along the Z-direction when the actuator 40 is turned from the open position to the close position in the present embodiment. As a result, if the actuator 40 is turned from the open position to the close position in a state where the FPC 5 is inserted in the insertion slot 2, then the FPC 5 can be held firmly by the abutment sections 52 and the contacting sections 12. That is, the FPC 5 can properly be pressed against the contacting sections 12 by the abutment sections 52. Here, outer surfaces of the semicircular shapes of the abutment sections 52 are brought into contact with the upper surface of the FPC 5.

The transmission section 54 includes a suppression section 55 and a press section 56. The suppression section 55 is brought into contact with the corresponding finger section 66 of the contact 60 and prevented from moving upward by the corresponding finger section 66 when the actuator 40 is located at the open position (see FIGS. 3 and 5). The press section 56 is pressed by the corresponding finger section 66 of the contact 60 when the actuator 40 is located at the close position (see FIGS. 4 and 5). In the present embodiment, since the finger sections 66 of the contacts 60 prevent upward movement of the suppression sections 55 of the pushers 50 when the actuator 40 is located at the open position, the actuator 40 is prevented from being separated from the housing 20. In the present embodiment, when the actuator 40 is located at the open position, the finger sections 66 of the contacts 60 only prevent upward movement of the suppression sections 55 of the pushers 50 and do not bias the pushers 50 toward the contacting sections 12 of the contacts 10. However, the present invention is not limited to this example. The contacts 60 may bias the pushers 50 toward the contacting sections 12 of the contacts 10 when the actuator 40 is located at the open position. Nevertheless, the configuration of the embodiment described above is preferable from the viewpoint of the manufacturing process of the connector 1, which will be described later.

The suppression section 55 of this embodiment is configured to have a surface that is substantially in parallel to the XY-plane when the actuator 40 is located at the open position. In other words, the suppression section 55 has a linear shape on the XZ-plane. The press section 56 of this embodiment also has a linear shape on the XZ-plane. The size of the press section 56 is about one-sixth to about one-eighth of that of the suppression section 55. Specifically, the pusher 50 has an elongated shape on the XZ-plane. In the present embodiment, the suppression section 55 is connected to the press section 56 by a smooth curved surface. Therefore, when the actuator 40 is turned from the open position to the close position, the finger sections 66 of the contacts 60 can smoothly move from above the suppression sections 55 to above the press sections 56. In the present embodiment, when the actuator 40 is located at the close position, the press sections 56 are not in parallel to the XY-plane. Therefore, the finger sections 66 apply forces to the press sections 56 in a direction that is slightly oblique to the Z-direction. Since the abutment sections 52 have a semicircular cross-section as described above, the FPC 5 is subject to a force only having a component parallel to the Z-direction. Thus, according to the present embodiment, the contacting sections 12 of the contacts 10 are prevented from being disconnected from the connection portion (wiring pattern) of the FPC 5.

The connector 1 having the above structure can be produced by inserting the pivots 42 into the pivot receivers 22 and then inserting the contacts 60 from the rear end 20*b* of the housing 20 toward the front end 20*a* in a state where the actuator 40 is located at the open position. At that time, the finger sections 66 of the contacts 60, particularly the front parts 68, are located above the suppression sections 55 of the pushers 50 within the communication slits 48. As described above, when the actuator 40 is located at the open position, the suppression sections 55 are in parallel to the XY-plane, so that no loads or only small loads are applied to the front parts 68 by the pushers 50. Accordingly, no unnecessary stress is applied to the front parts 68. Thus, the finger sections 66 of the contacts 60 are prevented from being deformed during the manufacturing process of the connector 1.

In the connector 1 according to the aforementioned embodiment of the present invention, the pushers 50 are configured to substantially press the FPC 5 only along the Z-direction without moving the FPC 5 toward the positive X-direction or the negative X-direction when the actuator 40 is turned from the open position to the close position. Therefore, the contacting sections 12 of the contacts 10 are prevented from being disconnected from the wiring pattern of the FPC 5.

Specifically, in a conventional connector, pushers are turned about an axis of turn of an actuator. Therefore, the amount of movement of the pushers is large. In the connector 1 according to the embodiment of the present invention, however, the centers C of the pivots 42 of the actuator 40 linearly move along the Z-direction. Therefore, the abutment sections 52 of the pushers 50 that abut the FPC 5 move only by slight distance or hardly move.

According to the present invention, when an actuator is turned from an open position to a close position in a state where an FPC/FFC is inserted in an insertion slot of a connector, a pusher pushes the FPC/FFC along a thickness direction (a direction perpendicular to an insertion direction). Therefore, a contacting section of a contact is prevented from being disconnected from a wiring pattern formed on the FPC/FFC.

The present application is based on a Japanese patent application of JP2009-174079 filed before the Japan Patent Office on Jul. 27, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a housing;

an insertion slot into which a connection target is inserted along an insertion direction;

an actuator having a pusher, the actuator being held by the housing so as to be turnable between an open position and a close position, the actuator allowing the connection target to be inserted into the insertion slot when the actuator is positioned at the open position, the pusher pushing the inserted connection target along a thickness direction of the connection target when the actuator is turned to the close position after the connection target is inserted into the insertion slot, the thickness direction being perpendicular to the insertion direction; and a biasing member operable to bias the pusher toward the inserted connection target when the actuator is located at the close position, wherein:

the actuator has a pivot about which the actuator is turned;

the housing is formed with a pivot receiver that receives the pivot;

the pivot has a circular cross-section on a plane defined by the insertion direction and the thickness direction;

the pivot receiver is formed as a groove extending along the thickness direction;

a width of the groove in the insertion direction is slightly larger than a diameter of the pivot;

the pusher includes an abutment section;

the abutment section is brought into contact with the inserted connection target when the actuator is turned from the open position to the close position;

the abutment section has a semicircular cross-section on a plane defined by the insertion direction and the thickness direction;

the semicircular cross-section of the abutment section is a half part of an imaginary circle having a center; and as seen along a width direction perpendicular to the insertion direction and the thickness direction, the center of the imaginary circle overlaps the center of the circular cross-section of the pivot in the insertion direction and the thickness direction.

2. The connector according to claim 1, wherein:

the pusher turns about the center of the imaginary circle; and the contact point of the abutment section with the inserted connection target moves only and completely along a line that passes through the center of the semicircular cross-section of the abutment section and extends along the thickness direction when the abutment section is pressed against the inserted connection target by turn of the actuator.

3. The connector according to claim 1, wherein the pivot receiver receives the pivot with regulating movement of the pivot along the insertion direction but allowing movement of the pivot along the thickness direction.

4. The connector according to claim 3, further comprising a contact having a contacting section that is brought into contact with the connection target, wherein:

the housing holds the contact; and the center of the pivot and the contacting section of the contact are arranged along the thickness direction.

5. The connector according to claim 3, wherein the pusher is turned about the center of the imaginary circle.

6. The connector according to claim 5, wherein:

the pusher includes a transmission section; and the transmission section is located between the biasing member and the abutment section to transmit a force applied by the biasing member to the abutment section when the actuator is located at the close position.

* * * * *